US009254561B2

(12) United States Patent
Hua

(10) Patent No.: US 9,254,561 B2
(45) Date of Patent: Feb. 9, 2016

(54) SWITCH MECHANISM FOR A PNEUMATIC TOOL

(71) Applicant: Basso Industry Corp., Taichung (TW)

(72) Inventor: Chiang Hua, Taichung (TW)

(73) Assignee: Basso Industry Corp., Taichung (TW)

( * ) Notice: Subject to any disclaimer, the term of this patent is extended or adjusted under 35 U.S.C. 154(b) by 536 days.

(21) Appl. No.: 13/744,430

(22) Filed: Jan. 18, 2013

(65) Prior Publication Data

US 2013/0186665 A1 Jul. 25, 2013

(30) Foreign Application Priority Data

Jan. 19, 2012 (TW) ..... 101102197 A

(51) Int. Cl.
*B25F 5/00* (2006.01)
*B25F 5/02* (2006.01)
*B25B 21/02* (2006.01)

(52) U.S. Cl.
CPC ... *B25F 5/00* (2013.01); *B25F 5/02* (2013.01); *B25B 21/02* (2013.01)

(58) Field of Classification Search
CPC ..... B25B 21/00; B25B 21/02; B25B 19/00; B25F 5/00; B25F 5/02
USPC ..... 173/93, 93.5, 168, 169, 170, 218, 219, 173/221
See application file for complete search history.

(56) References Cited

U.S. PATENT DOCUMENTS

| | | | | | |
|---|---|---|---|---|---|
| 2,813,514 | A * | 11/1957 | Von Seggern | 91/329 |
| 3,326,240 | A * | 6/1967 | McConnaughay | 137/637.4 |
| 5,303,781 | A * | 4/1994 | Lin | 173/169 |
| 5,797,462 | A * | 8/1998 | Rahm | 173/169 |
| 5,918,686 | A * | 7/1999 | Izumisawa | 173/20 |
| 6,044,917 | A * | 4/2000 | Brunhoelzl | 173/93.5 |
| 6,062,323 | A * | 5/2000 | Pusateri et al. | 173/169 |
| 7,213,500 | B2 * | 5/2007 | Chang | 91/418 |
| 7,222,680 | B2 * | 5/2007 | Livingston et al. | 173/177 |
| 7,311,155 | B2 * | 12/2007 | Chang | 173/104 |
| 7,431,102 | B2 | 10/2008 | Hua et al. | |
| 7,461,704 | B2 * | 12/2008 | Chen | 173/169 |
| 7,594,549 | B2 | 9/2009 | Hua | |
| 8,074,733 | B2 * | 12/2011 | Liu | 173/169 |
| 2004/0144553 | A1 * | 7/2004 | Ashbaugh | 173/169 |

* cited by examiner

*Primary Examiner* — Scott A. Smith
(74) *Attorney, Agent, or Firm* — CKC & Partners Co., Ltd.

(57) ABSTRACT

A switch mechanism for a pneumatic tool includes a rotating body and a lever. The rotating body has a surface, wherein a combining portion is disposed on the surface. The lever is slidably disposed in the combining portion, wherein the lever includes a first operating end and a second operating end, and either one of the first operating end and the second operating end protruding from the pneumatic tool or both the first operating end and the second operating end protruding from the pneumatic tool are controlled by pushing the lever along an extending direction of the combining portion.

5 Claims, 9 Drawing Sheets

SWITCH MECHANISM FOR A PNEUMATIC TOOL

RELATED APPLICATIONS

The application claims priority to Taiwan Application Serial Number 101102197 filed Jan. 19, 2012, which is herein incorporated by reference.

BACKGROUND

1. Technical Field

The present disclosure relates to a switch mechanism for a pneumatic tool. More particularly, the present disclosure relates to a switch mechanism for a pneumatic tool favoring both right-handed users and left-handed users to operate with only one hand.

2. Description of Related Art

A pneumatic tool is a tool driven by pressurized air for screwing or drilling, such as a pneumatic drill or a pneumatic wrench. A forward air channel, a reverse air channel and a reversible valve are disposed inside the pneumatic tool. When the pneumatic tool is in a forward operation mode in which a fastener is tightened, a gas port of the reversible valve is communicated with the forward air channel, so that the pressurized air can flow into the forward air channel for driving the pneumatic tool to rotate in a forward direction. In similar fashion, when the pneumatic tool is in a reverse operation mode, the gas port of the reversible valve is communicated with the reverse air channel, so that the pressurized gas can flow into the reverse air channel for driving the pneumatic tool to rotate in a reverse direction. The pneumatic tool is typically provided with a switch mechanism for switching an operation mode of the pneumatic tool between the forward operation mode and the reverse operation mode.

A conventional switch mechanism usually includes a lever which unilaterally protrudes from a predetermined side of the pneumatic tool. Due to the right-handed users are far more than the left-handed users, the side of the pneumatic tool where the lever protrudes from is mostly designed for the right-handed users. When a right-handed user holds the pneumatic tool with a right hand, the right-handed user can toggle the protruding portion of the lever up or down with a right thumb for driving the reversible valve to rotate so as to control the gas port of the reversible valve to communicate with the forward air channel or the reverse air channel. In other words, the right-handed user can operate the pneumatic tool with only one hand.

However, when a left-handed user holds the aforementioned pneumatic tool with a left hand, the left-handed user have to toggle the protruding portion of the lever up or down with a thumb of the other hand. During work, the other hand is usually occupied with other items such as bolts, nut, and the likes. Therefore, such pneumatic tool is unfavorable to the left-handed user.

For solving the foregoing problem, another kind of pneumatic tool with a lever bilaterally protruding from the pneumatic tool is disclosed. The lever of the pneumatic tool cannot be adjusted to unilaterally protrude from the pneumatic tool. Both the right-handed user and the left-handed user can hold the pneumatic tool and toggle the lever with only one hand. That means both the right-handed user and the left-handed user only use one of the two protruding portions of the lever, and the other protruding portion of the lever becomes a redundant burden. For example, when the user is working in a confined space, the user is further confined in the space due to the extra protruding portion of the lever. Moreover, an unexpected change of a rotation direction of the pneumatic tool may be caused by inadvertently hitting the extra protruding portion of the lever.

The protruding portion of the lever may be shortened in length to reduce the chance of inadvertent hits. However, when the length of the protruding portion of the lever is shortened, it inevitably becomes more difficult for the user to toggle the lever, because a greater force is needed for toggling the lever. Therefore, the aforementioned pneumatic tool is unfavorable to the users.

SUMMARY

A switch mechanism for a pneumatic tool includes a rotating body and a lever. The rotating body has a surface, wherein a combining portion is disposed on the surface. The lever is slidably disposed in the combining portion, wherein the lever includes a first operating end and a second operating end, and either one of the first operating end and the second operating end protruding from the pneumatic tool or both the first operating end and the second operating end protruding from the pneumatic tool are controlled by pushing the lever along an extending direction of the combining portion.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
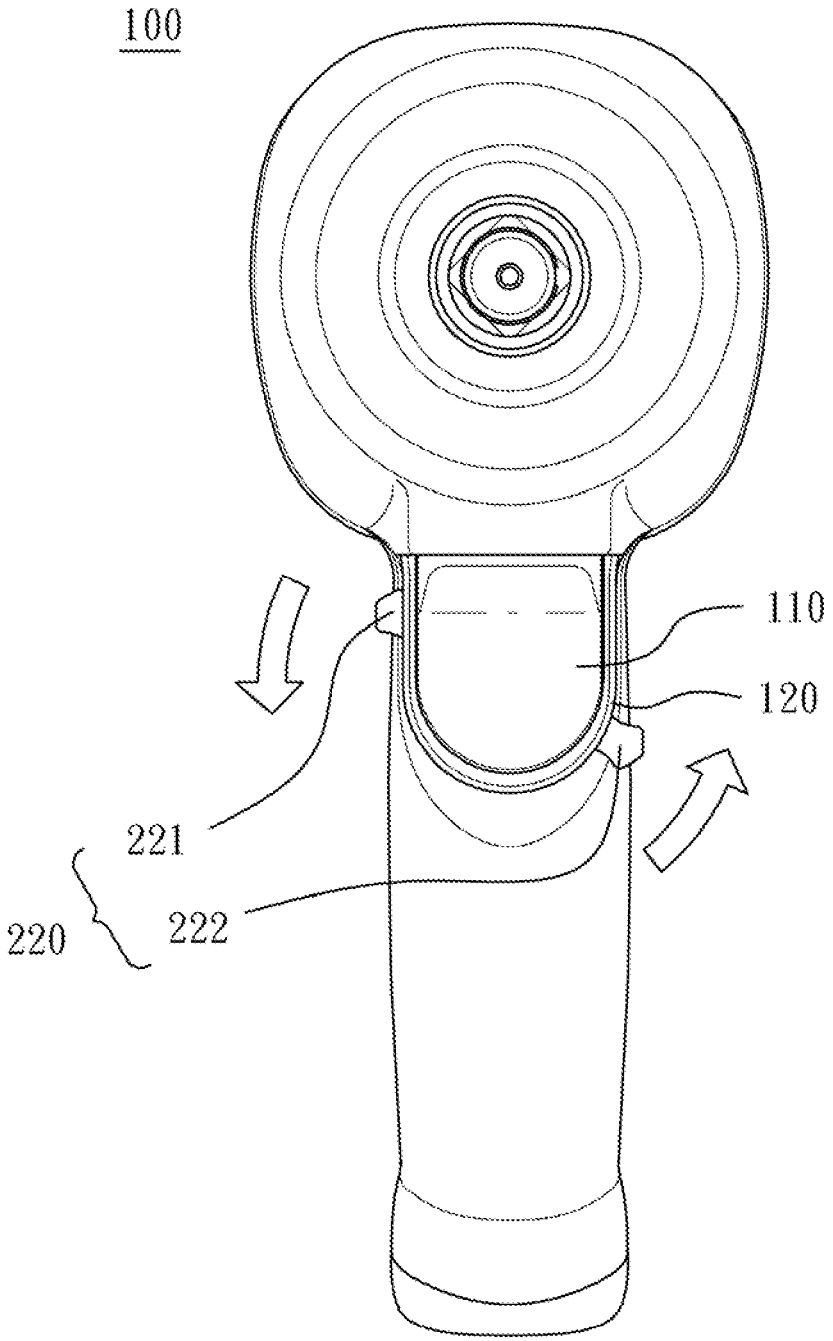
FIG. 1A is a front view of a pneumatic tool according to one embodiment of the present disclosure in a forward operation mode.
Figure 1B:
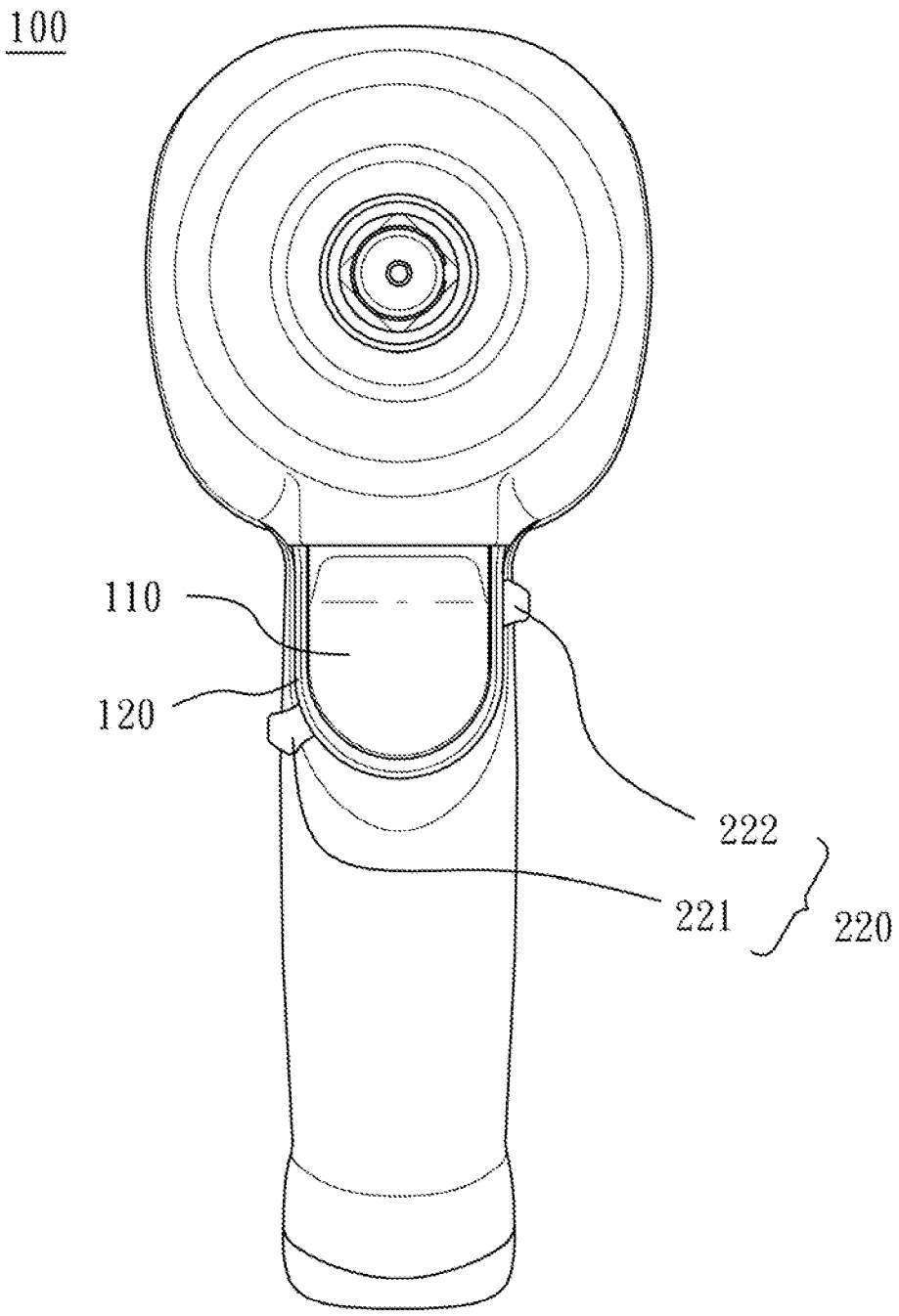
FIG. 1B is a front view of the pneumatic tool shown in FIG. 1A in a reverse operation mode.

FIG. 1A is a front view of a pneumatic tool 100 according to one embodiment of the present disclosure in a forward operation mode. FIG. 16 is a front view of the pneumatic tool 100 shown in FIG. 1A. In FIG. 1A, the pneumatic tool 100 includes a trigger button 110 and a lever 220. The lever 220 includes a first operating end 221 and a second operating end 222. Both the first operating end 221 and the second operating end 222 protrude from the pneumatic tool 100. Therefore, both the right-handed users and left-handed users can operate the pneumatic tool 100 with only one hand. When the lever 220 is in a position as illustrated in FIG. 1A, i.e. an extending direction of the lever 220 is about 45 degrees clockwise relative to a horizontal line, a gas port of a reversible valve inside the pneumatic tool 100 is communicated with a forward air channel (, which is not shown in FIG. 1A). When the trigger button 110 is pressed, the pressurized air is allowed to flow into the forward air channel from the gas port for driving the pneumatic tool 100 to rotate in a forward direction. When a force is applied on the first operating end 221 or the second operating end 222 along one of the arrows shown in FIG. 1A, the position of the lever 220 in FIG. 1A is changed to another position as shown in FIG. 1B. In FIG. 1B, the gas port of the reversible valve inside the pneumatic tool 100 is communicated with a reversible air channel (, which is not shown in FIG. 1B). When the trigger button 110 is pressed, the pressurized air is allowed to flow into the reversible air channel from the gas port for driving the pneumatic tool 100 to rotate in a reversible direction.

Figure 2:
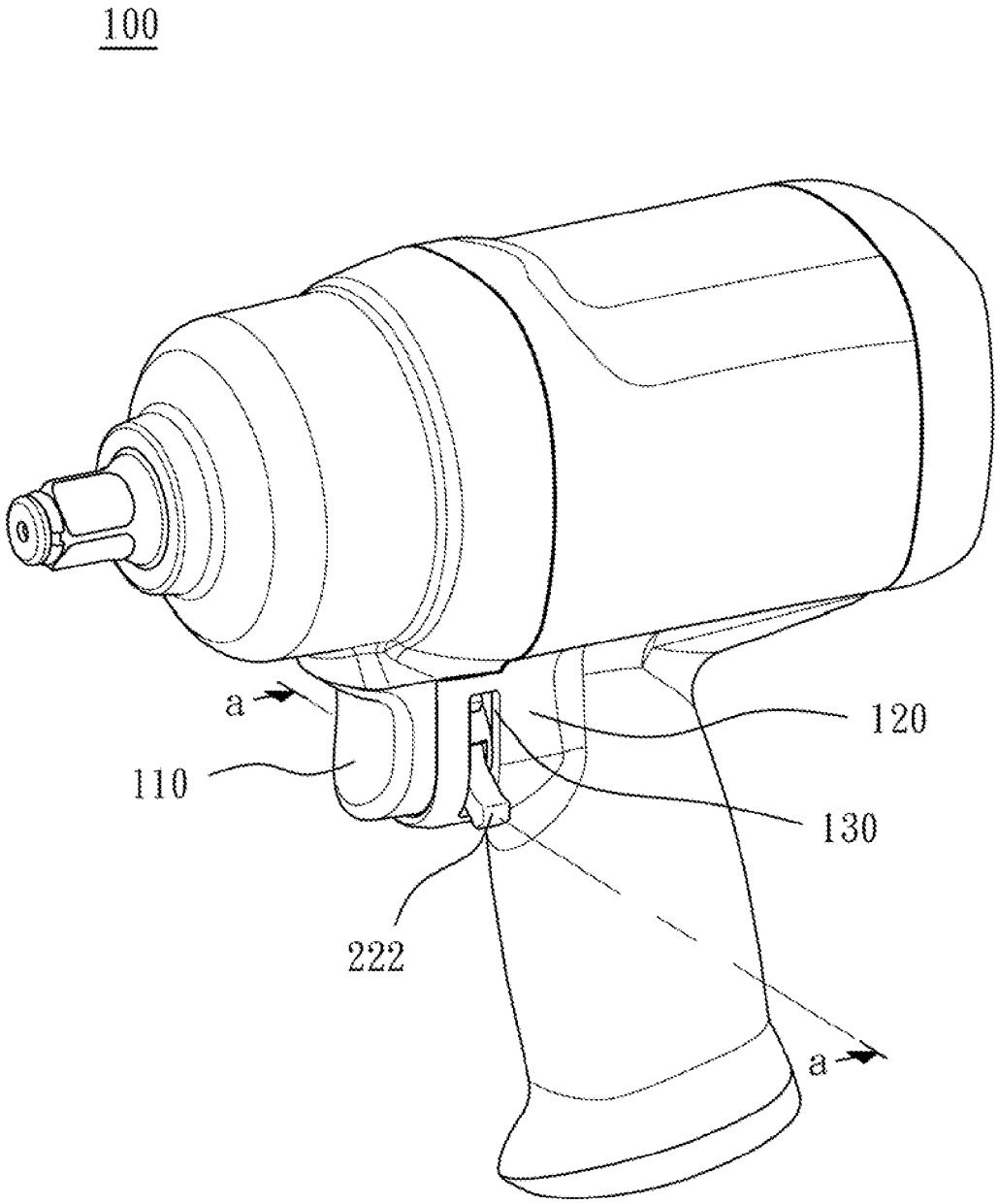
FIG. 2 is a perspective view of the pneumatic tool shown in FIG. 1A.

FIG. 2 is a perspective view of the pneumatic tool 100 shown in FIG. 1A. In FIG. 2, two rectangular openings 130 are respectively disposed on two sides of a casing 120 of the pneumatic tool 100 (, only one rectangular openings 130 is shown). The two rectangular openings 130 allow the first operating end 221 and the second operating end 222 respectively to move along the longitudinal direction thereof for switching the forward operation mode and the reverse operation mode.

Figure 3:
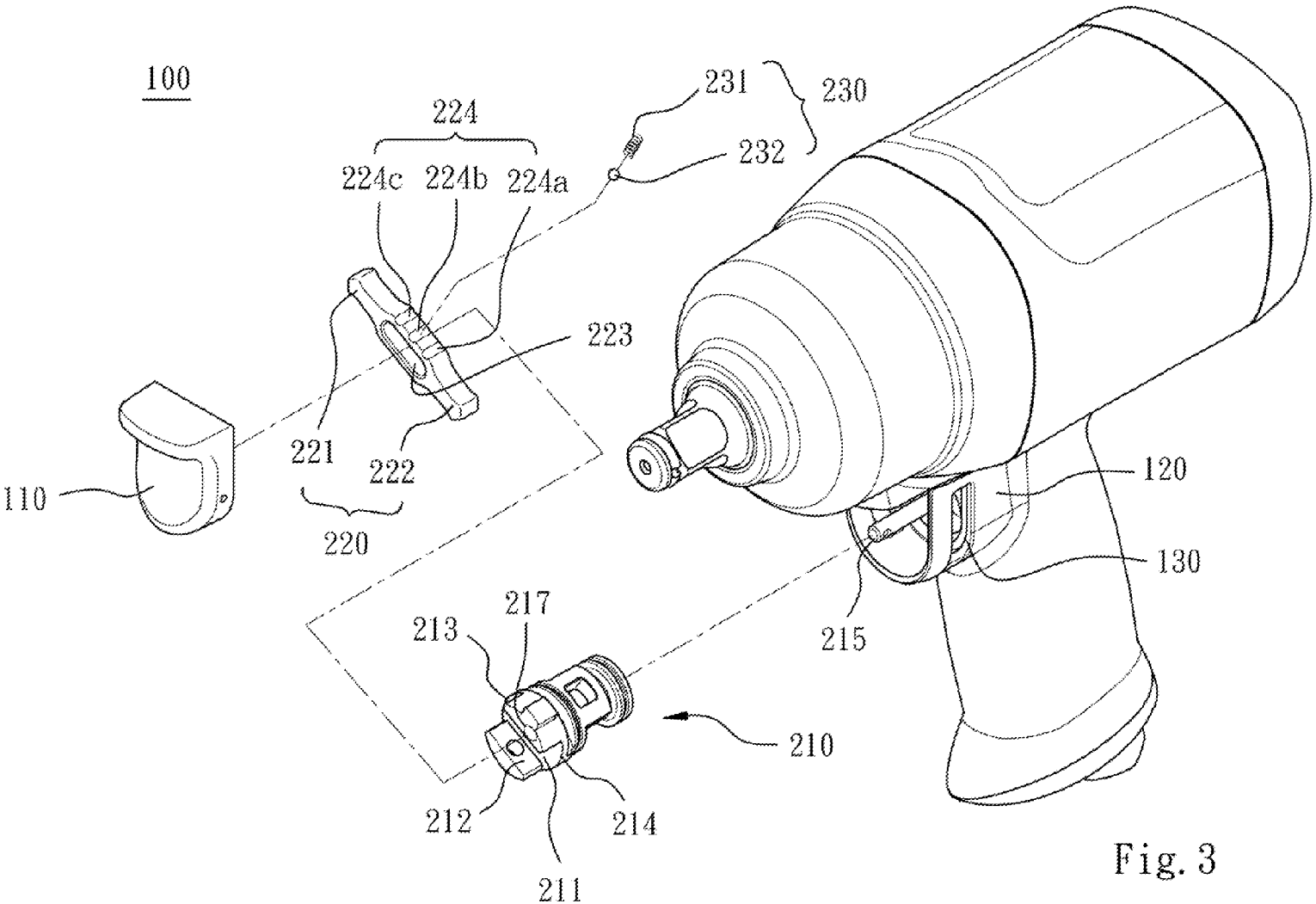
FIG. 3 is a partially exploded view of the pneumatic tool shown in FIG. 2.
Figure 4A:
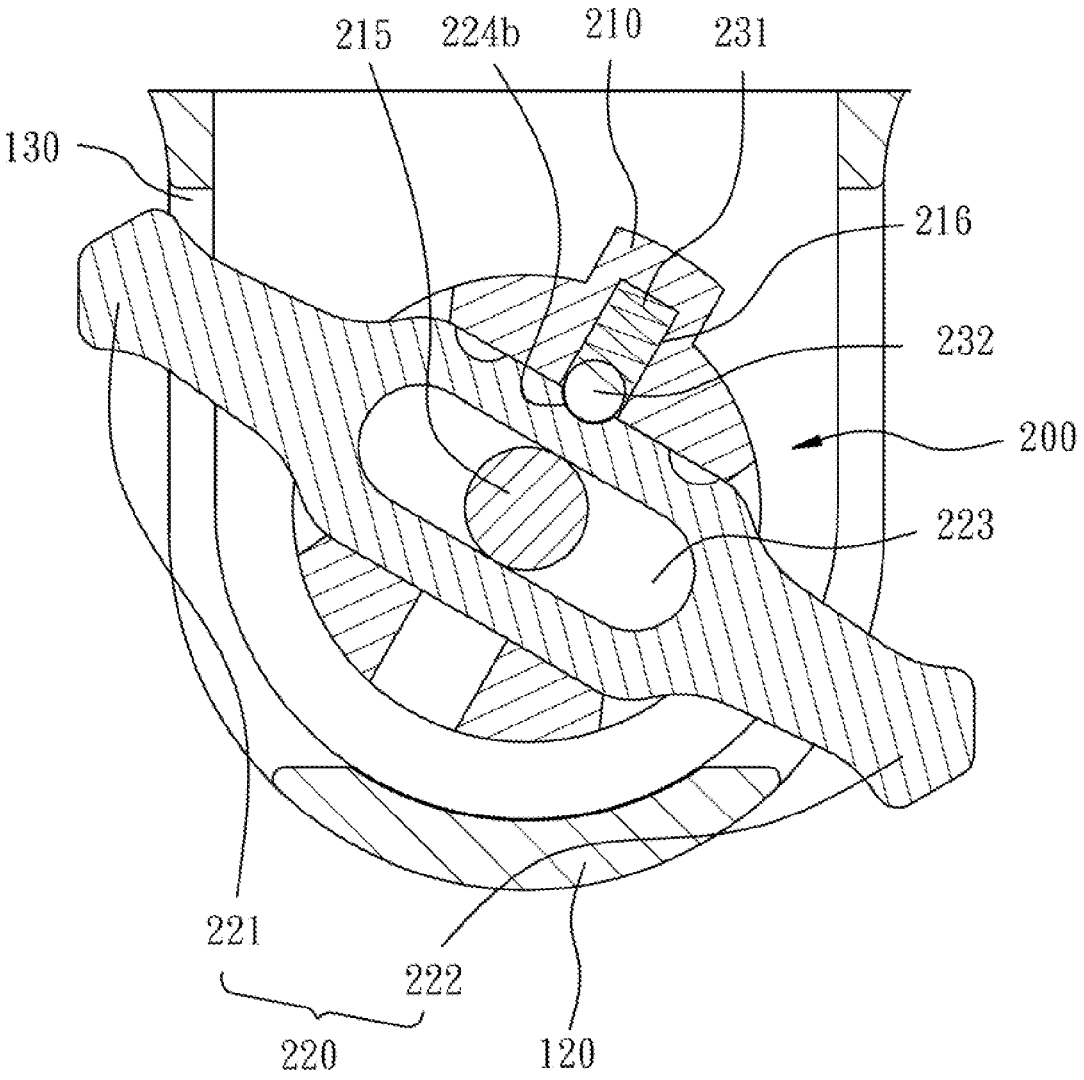
FIG. 4A is a sectional view taken along line a-a of a switch mechanism of the pneumatic tool shown in FIG. 2.
Figure 4B:
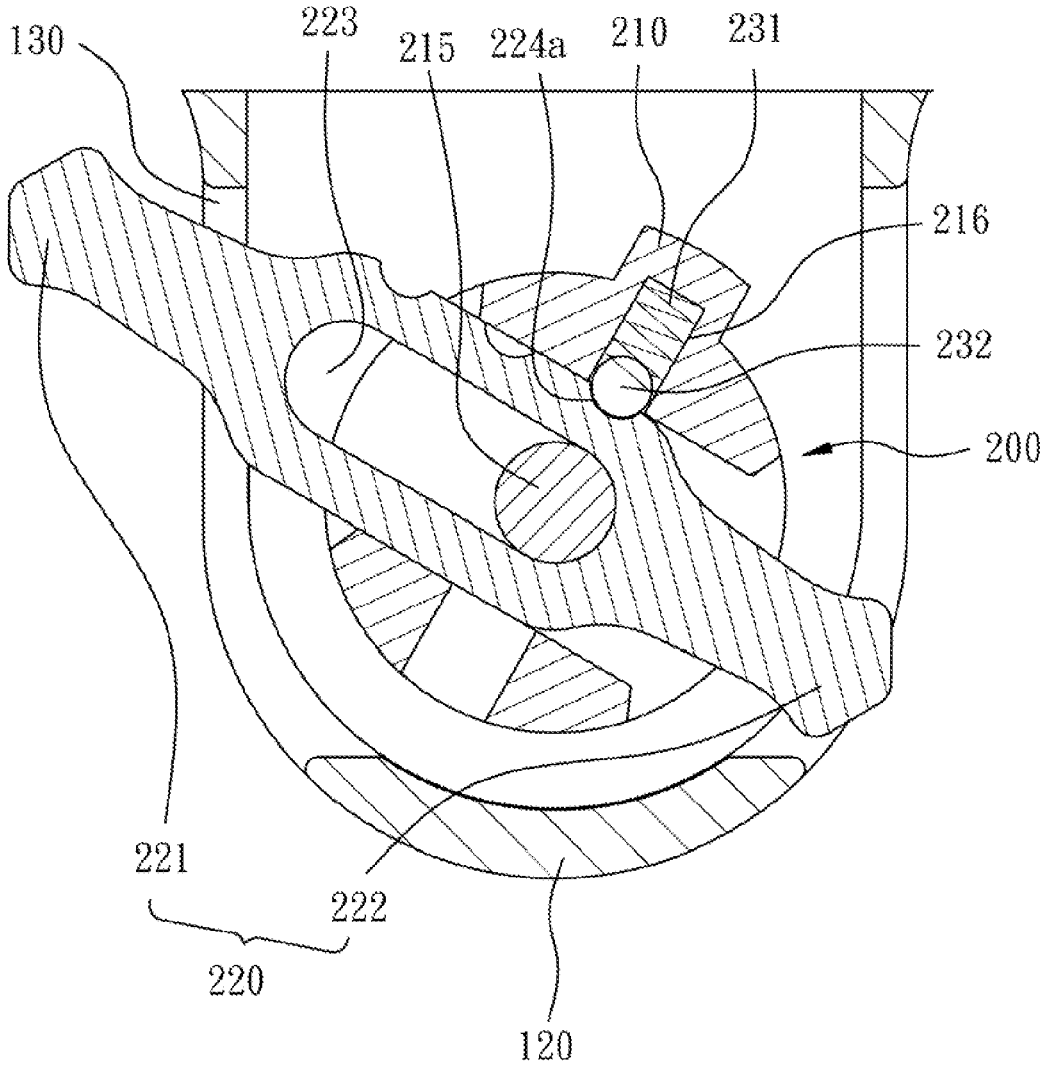
FIG. 4B shows a lever as illustrated in FIG. 4A in another position.
Figure 4C:
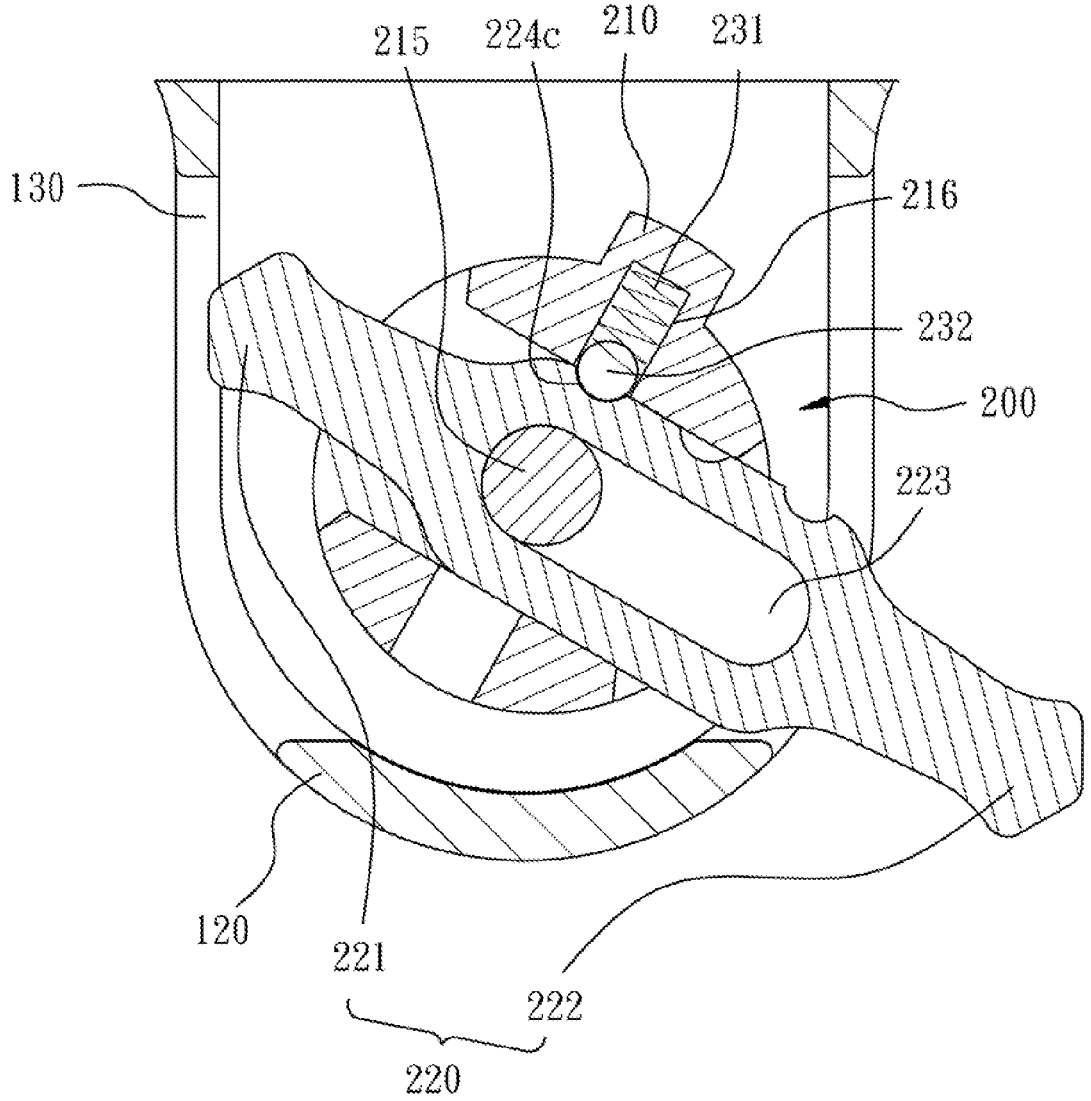
FIG. 4C shows the lever as illustrated in FIG. 4A in yet another position.

FIG. 3 is a partially exploded view of the pneumatic tool 100 shown in FIG. 2. FIG. 4A is a sectional view taken along line a-a, of a switch mechanism 200 of the pneumatic tool 100 shown in FIG. 2. FIG. 4B shows the lever 220 as illustrated in FIG. 4A in another position. FIG. 4C shows the lever 220 as illustrated in FIG. 4A in yet another position. In FIG. 3, the switch mechanism 200 of the pneumatic tool 100 includes a rotating body 210 and the lever 220. The rotating body 210 has a surface, wherein a combining portion 211 is disposed on the surface. The lever 220 is slidably disposed in the combining portion 211. In the embodiment, the combining portion 211 is formed as a groove and includes two edges 212, a first opening 213 and a second opening 214. A depth and a width of the groove are defined respectively by a height of the two edges 212 and a distance between the two edges 212. The depth and the width of the groove are defined for accommodating the lever 220. The first opening 213 and the second opening 214 are located respectively at two ends of the groove for allowing the first operating end 221 and the second operating end 222 to protrude from the groove respectively. In the embodiment, a through hole 217 is disposed at a center of the rotating body 210 for allowing a positioning axis 215 to insert through the through hole 217 and protrude from the combining portion 211.

The lever 220 further includes a center hole 223 and a positioning portion 224. The center hole 223 is disposed at a center of the lever 220. The positioning axis 215 fits in the center hole 223 for avoiding the lever 220 detaching from the combining portion 211, and a size of the center hole 223 can further limit a sliding range of the lever 220.

The positioning portion 224 has a first indentation 224*a*, a second indentation 224*b* and a third indentation 224*c*. A distance between the first indentation 224*a* and the second indentation 224*b* substantially equals to a distance between the second indentation 224*b* and the third indentation 224*c*. A receiving groove 216 is disposed at the edge 212 of the combining portion 211 corresponding to the positioning portion 224 of the lever 220, and a positioning member 230 is received in the receiving groove 216. The positioning member 230 includes a spring 231 and a ball 232. The ball 232 is abutted against the first indentation 224*a*, the second indentation 224*b* or the third indentation 224*c* by the spring 231 so as to push the lever 220 against the other edge 212 of the combining portion 211. Therefore, the lever 220 is positioned in the combining portion 211. By the design of the corresponding relationship of the positioning member 230 and the positioning portion 224, the positioning stability between the lever 220 and the combining portion 211 is reinforced. The lever 220 can be pushed along an extending direction of the combining portion 211 for selecting a desired indentation (i.e. the first indentation 224*a*, the second indentation 224*b* or the third indentation 224*c*) to engage with the ball 232, so that either one of the first operating end 221 and the second operating end 222 protruding from the pneumatic tool 100 or both the first operating end 221 and the second operating end 222 protruding from the pneumatic tool 100 are controlled.

In FIG. 4A, the ball 232 is abutted against the second indentation 224*b* of the lever 220 and both the first operating end 221 and the second operating end 222 protrude from the pneumatic tool 100. Therefore, both the right-handed users and left-handed users can hold the pneumatic tool 100 and toggle the lever 220 with only one hand.

In FIG. 4B, the ball 232 is abutted against the first indentation 224*a* of the lever 220 and only the first operating end 221 protrudes from the pneumatic tool 100, which is favorable for the left-handed users. The left-handed users can hold the pneumatic tool 100 with a left hand, and toggle the first operating end 221 downward with a left thumb for switching the operation mode of pneumatic tool 100.

In FIG. 4C, the ball 232 is abutted against the third indentation 224*c* of the lever 220 and only the second operating end 222 protrudes from the pneumatic tool 100, which is favorable for the right-handed users. The right-handed users can hold the pneumatic tool 100 with a right hand, and toggle the second operating end 222 upward with a right thumb for switching the operation mode of pneumatic tool 100.

Figure 5A:
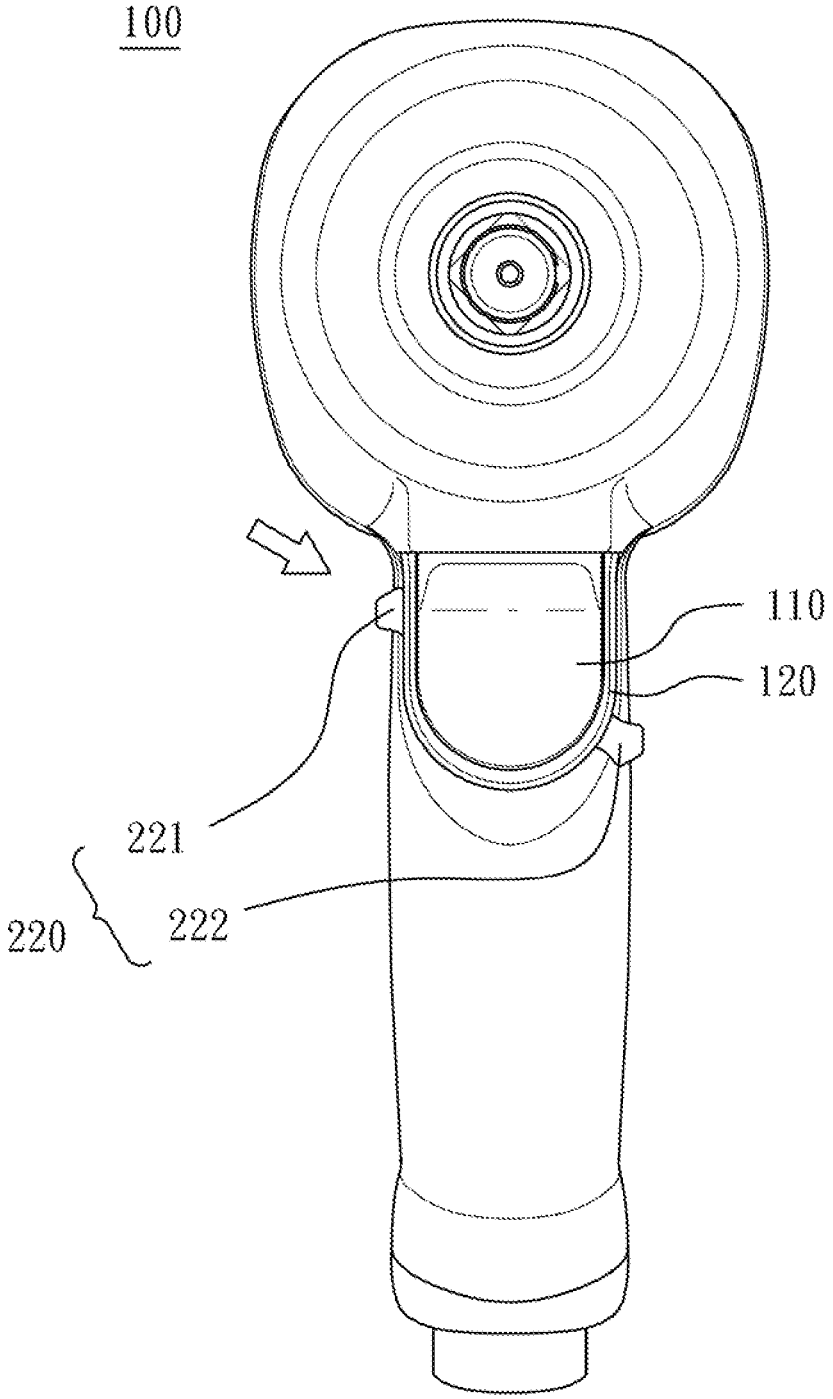
FIG. 5A is an operating schematic view of the lever shown in FIG. 1A.
Figure 5B:
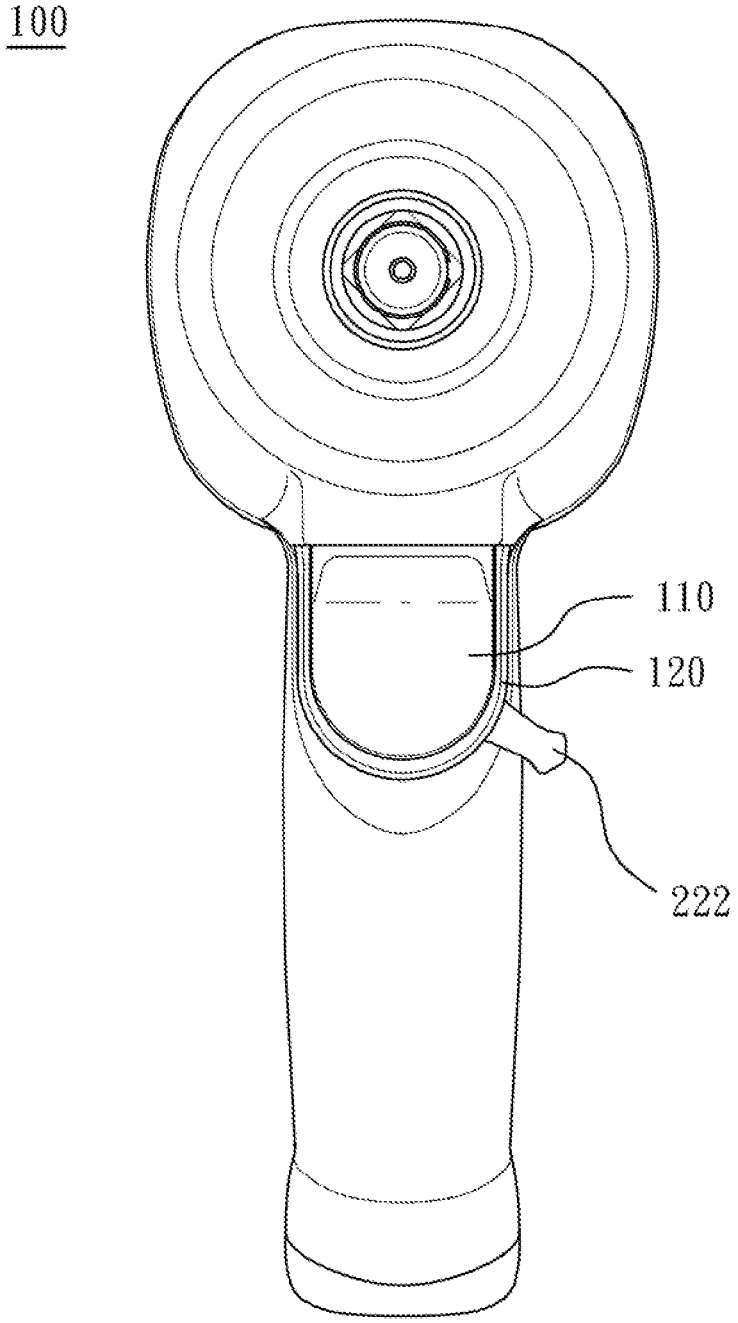
FIG. 5B shows an operating result of FIG. 5A.

FIG. 5A is an operating schematic view of the lever 220 shown in FIG. 1A. FIG. 5B shows an operating result of FIG. 5A. In FIG. 5A, both the first operating end 221 and the second operating end 222 protruding from the pneumatic tool 100. When a force is applied on the first operating end 221 along a direction of an arrow shown in FIG. 5A, the lever 220 is slid in the combining portion 211 along the direction of the arrow. As a result, only the second operating end 222 protrudes from the pneumatic tool 100, as shown in FIG. 5B.

Please refer to FIG. 5A. In similar fashion, when a force is applied on the second operating end 222 along an opposing direction of the arrow shown in FIG. 5A, the lever 220 is slid in the combining portion 211 along the opposing direction of the arrow. As a result, only the first operating end 221 protrudes from the pneumatic tool 100.

According to the foregoing embodiment, the lever is slidably disposed in the combining portion, so that the user can control the lever to protrude unilaterally or bilaterally from the pneumatic tool according to their habits. Therefore, the pneumatic tool is convenient and flexible in operation and can satisfy both the right-handed users and the left-handed users.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A switch mechanism for a pneumatic tool, comprising:

a rotating body having a surface, wherein combining portion is disposed on the surface, and the combining portion is formed as a groove; and a lever slidably disposed in the combining portion, wherein the lever comprises a first operating end and a second operating end;

wherein the combining portion comprises two edges and two openings, the two edges defines a depth and a width of the groove for accommodating the lever, the two openings are located respective at two ends of the groove for wing the first operating end and the second operating end to protrude from the groove, and either one of the first operating end and the second operating end protruding from the pneumatic tool or both the first operating end and the second operating end protruding from the pneumatic tool are controlled by pushing the lever along an extending direction of the combining portion.

2. The switch mechanism for a pneumatic tool of claim 1, wherein:

a positioning axis is disposed at a center of the rotating body; and a center hole is disposed at a center of the lever, and the positioning axis fits in the center hole for avoiding the lever detaching from the combining portion.

3. The switch mechanism for a pneumatic tool of claim 1, wherein:

a receiving groove is disposed at one of the two edges of the combining portion and a positioning member is received' in the receiving groove; and a positioning portion is disposed at the lever corresponding to the positioning member so as to position the lever in the combining portion.

4. The switch mechanism for a pneumatic tool of claim 3, wherein:

the positioning member comprises a spring and a ball, and the ball is abutted against the positioning portion of the lever by the spring so as to push the lever against the other edge of the combining portion, whereby the lever is positioned in the combining portion.

5. The switch mechanism for a pneumatic tool of claim 3, wherein the positioning portion of the lever comprises a first indentation, a second indentation and a third indentation, and a distance between the first indentation and the second indentation substantially equals to a distance between the second indentation and the third indentation.

* * * * *